United States Patent [19]

Lovett

[11] 4,080,679

[45] Mar. 28, 1978

[54] COMPREHENSIVE PAD BOX

[75] Inventor: Albert Edward Lovett, Frisby-on-the-Wreake, England

[73] Assignee: USM Corporation, Boston, Mass.

[21] Appl. No.: 736,704

[22] Filed: Oct. 29, 1976

[51] Int. Cl.[2] ..... A43D 89/00; A43D 63/00

[52] U.S. Cl. ..... 12/38; 12/16.1

[58] Field of Search ..... 12/16.1, 16.4, 33, 33.2, 12/33.4, 33.6, 36, 38

[56] References Cited

U.S. PATENT DOCUMENTS

| | | | |
|---|---|---|---|
| 2,497,195 | 2/1950 | Woodman et al. | 12/38 |
| 2,501,789 | 3/1950 | Senfleben | 12/33.2 |
| 2,568,065 | 9/1951 | Gulbrandsen | 12/38 |
| 2,656,553 | 10/1953 | Woodman | 12/38 |

*Primary Examiner*—Patrick D. Lawson

*Attorney, Agent, or Firm*—Carl E. Johnson; Richard B. Megley; Vincent A. White

[57] ABSTRACT

A pad box for conforming the bottom of a shoe to that of a last comprises shoe bottom engaging material, a forepart supporting member and a waist supporting member both engageable with the material, the members being pivotally interconnected, means for adjusting the angle between the members, and a further adjusting means by which both members may be jointly tilted without altering a selected angle of adjustment between the members. Additionally, the pad box preferably includes a means for varying the effective length of the waist engaging member.

3 Claims, 3 Drawing Figures

COMPREHENSIVE PAD BOX

BACKGROUND OF THE INVENTION

This invention is concerned with improvements in or relating to the manufacture of shoes and is especially concerned with improvements in pad boxes suitable for use in applying pressure to the bottoms of shoes.

The term "shoe" is used herein generically to include outer footwear generally whether ready for wear or in the course of manufacture and the term "sole" is used herein to include sole and heel units formed in one piece or assembled prior to attachment to shoes.

It is a well-known operation in the manufacture of shoes having a sole attached by means of adhesive composition to apply pressure thereto after the sole has been positioned on the bottom of the shoe in order to effect a firm bond. This operation is carried out using a pad box including shoe bottom engaging material which conforms to the shape of the bottom of the shoe to enable pressure to be applied substantially uniformly over the bottom of the shoe. The pad box is mounted in a press and the shoe positioned on the pad box and pressure is applied thereto by operation of the press. However, as shoes differ widely in shape and size, it is desirable that a pad box be capable of being adjusted so that shoe bottom engaging material thereof can conform to a wide range of shoe bottom shapes and sizes. Furthermore, it is desirable that a pad box be capable of easy and rapid conformity.

In the prior art U.S. Pat. Nos. 2,501,789 and 2,656,553 may be noted as disclosing pad box structure of interest in providing conformity.

It is one of the various objects of the present invention to provide an improved pad box suitable for use in applying pressure to the bottom of a shoe, which pad box is capable of easy and rapid adjustment to conform to a variety of shoe bottom shapes and sizes.

There is hereinafter described in detail, with reference to the accompanying drawings, a pad box suitable for use in applying pressure to the bottom of a shoe which illustrates the invention by way of example. The illustrative pad box comprises a framework which comprises two side plates and transversely-extending members which interconnect the side plates. The framework supports the remaining parts of the pad box and can be mounted in a press so that the box can be used in applying pressure to the bottom of a shoe. The illustrative pad box also comprises a support for the shoe bottom engaging material mounted for pivoting movement on the framework of the box. The support comprises a first supporting member which is pivoted on the framework so that the support can pivot bodily, and a second supporting member which is pivoted on the first supporting member.

The illustrative pad box also comprises shoe bottom engaging material extending over the first and the second supporting members. This material is in the form of a leather sheet which is so arranged that, when the illustrative pad box is in use to apply pressure to the bottom of a shoe, a portion of the leather sheet supported by the first supporting member engages a forepart portion of the shoe bottom and a portion of the leather sheet supported by the second supporting member engages a waist portion of the shoe bottom. In order that the angle between the first and the second supporting members may be adjusted to conform to the angle between the forepart portion and the waist portion of the bottom of a shoe, the illustrative pad box comprises first means for adjustably pivoting the second supporting member on the first supporting member. The first adjustment means comprises a screw mounted for rotation on the first supporting member to move a block connected to the second supporting member thereby causing the second supporting member to pivot about its pivotal interconnection with the first supporting member.

The illustrative pad box also comprises second adjustment means by which the support comprising the first and second supporting members may be adjusted by being pivoted relative to the framework without alteration of a selected angle between the two supporting members. The second adjustment means comprises an adjustment screw pivotally mounted on the framework and arranged to move a block which is pivotally interconnected with the first supporting member thereby to cause the support to pivot bodily on the framework. This adjustment allows the support to be adjusted pivotally to bring a surface of a last, on which a shoe is supported, substantially parallel to a surface of a post of a press in which the illustrative pad box is mounted. The post of the press can then suitably apply distributed pressure to the last and therefore to the bottom of the shoe on the last.

The illustrative pad box also comprises adjustment means for varying the length of the second supporting member. This adjustment means comprises a pair of screws arranged to move two bars of the second supporting member relative to one another to alter the length of the support effectively given by the second supporting member to the leather sheet. These bar portions of the second supporting member are slidable relative to one another so that their combined length can be adjusted while still providing a substantially continuous supporting surface for the leather sheet. This allows the pad box to be adjusted so that the length of the second supporting member conforms to the length of the waist portion of the bottom of the shoe.

If it is desired to use the illustrative pad box to apply pressure to the bottom of a shoe to which a heel has not yet been attached, a supporting member in the form of a plate of the illustrative pad box can be used to support shoe bottom engaging material in the form of a rubber pad and arranged to apply pressure to the heel portion of the bottom of the shoe. The plate can be adjusted in inclination, height and longitudinal position to conform to the second supporting member.

SUMMARY OF THE INVENTION

The invention provides, in one of its several aspects, a pad box suitable for use in applying pressure to the bottom of a shoe, the pad box comprising a framework, a support for shoe bottom engaging material mounted for pivoting movement on the framework, the support comprising a first supporting member and a second supporting member, the shoe bottom engaging material extending over the support so that a portion of the material supported by the first supporting member engages a forepart portion of the shoe bottom and a portion of the material supported by the second supporting member engages a waist portion of the shoe bottom, the first supporting member and the second supporting member being pivotally interconnected, first adjustment means by which the angle between the first and second supporting members may be adjusted, and second adjustment means by which the support may be tilted or adjusted pivotally relative to the framework without alteration of the selected angle between the two supporting members.

In a pad box as set out in the last preceding paragraph, it is preferred that the pad box also comprises adjustment means for varying the effective length of the second supporting member.

BRIEF DESCRIPTION OF THE DRAWINGS

The above and other of the various objects and several aspects of the invention will become more clear from the following detailed description, to be read with reference to the accompanying drawings, of the illustrative pad box aforementioned. It is to be understood that the illustrative pad box has been selected for description by way of example only and not of limitation of the invention.

In the accompanying drawings.

DESCRIPTION OF PREFERRED EMBODIMENT

Figure 1:
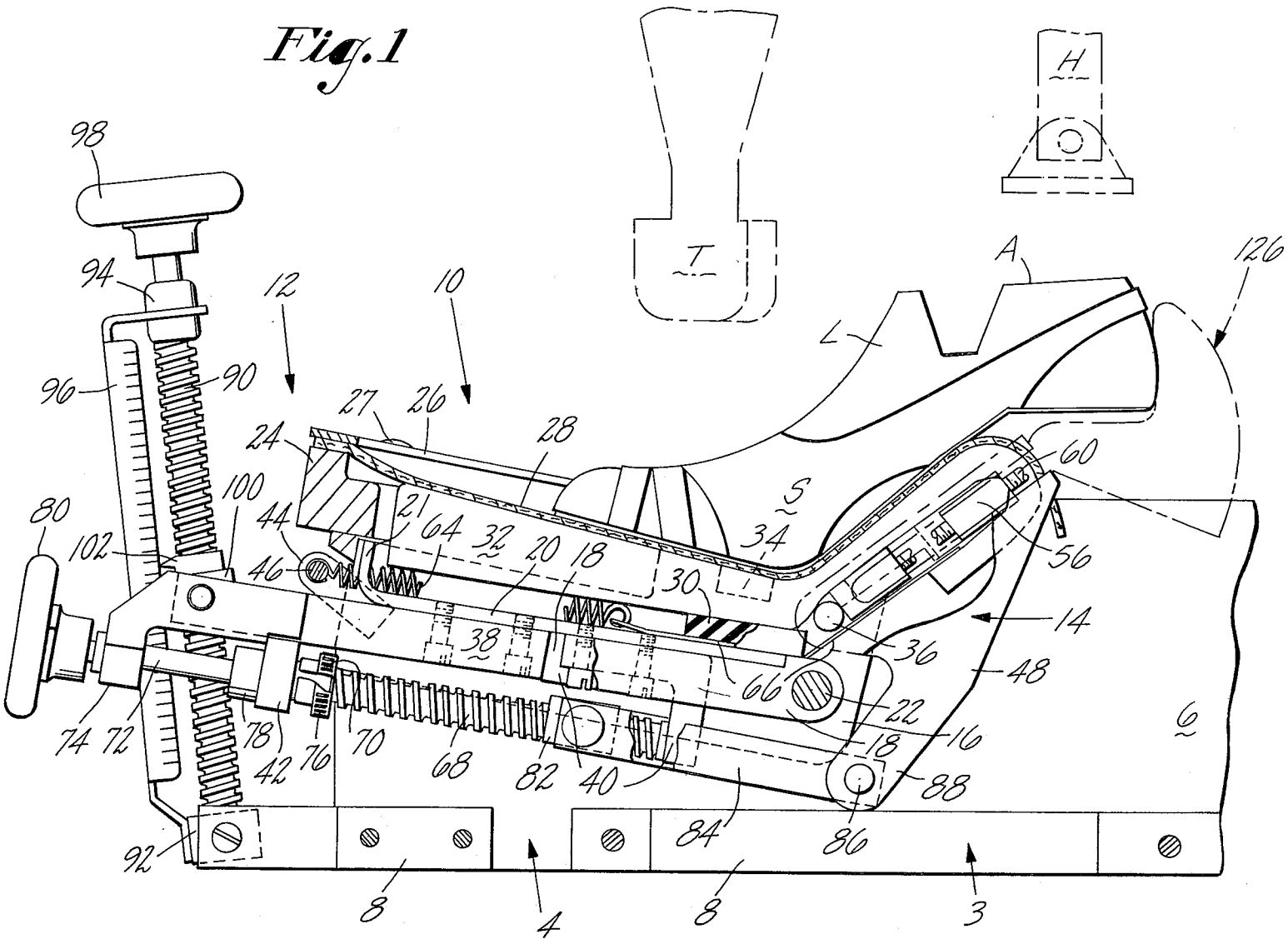
FIG. 1 is a side elevational view of a forward or toe end portion of an illustrative pad box assembly with a side plate of the pad box removed and certain parts sectioned or broken away to show the construction.

The illustrative pad box, generally indicated by reference character 3, is suitable for use in applying pressure to the bottom of a shoe, for example a shoe S on a last L shown in FIG. 1. The pad box 3 comprises a framework 4 which supports other parts of the box 3. The framework 4 comprises two side plates 6 which extend longitudinally of the box 3 and connecting members 8 which extend transversely of the box 3 interconnecting the side plates 6 (one of the plates 6 is visible in FIGS. 1 and 2 but the other has been removed).

Figure 3:
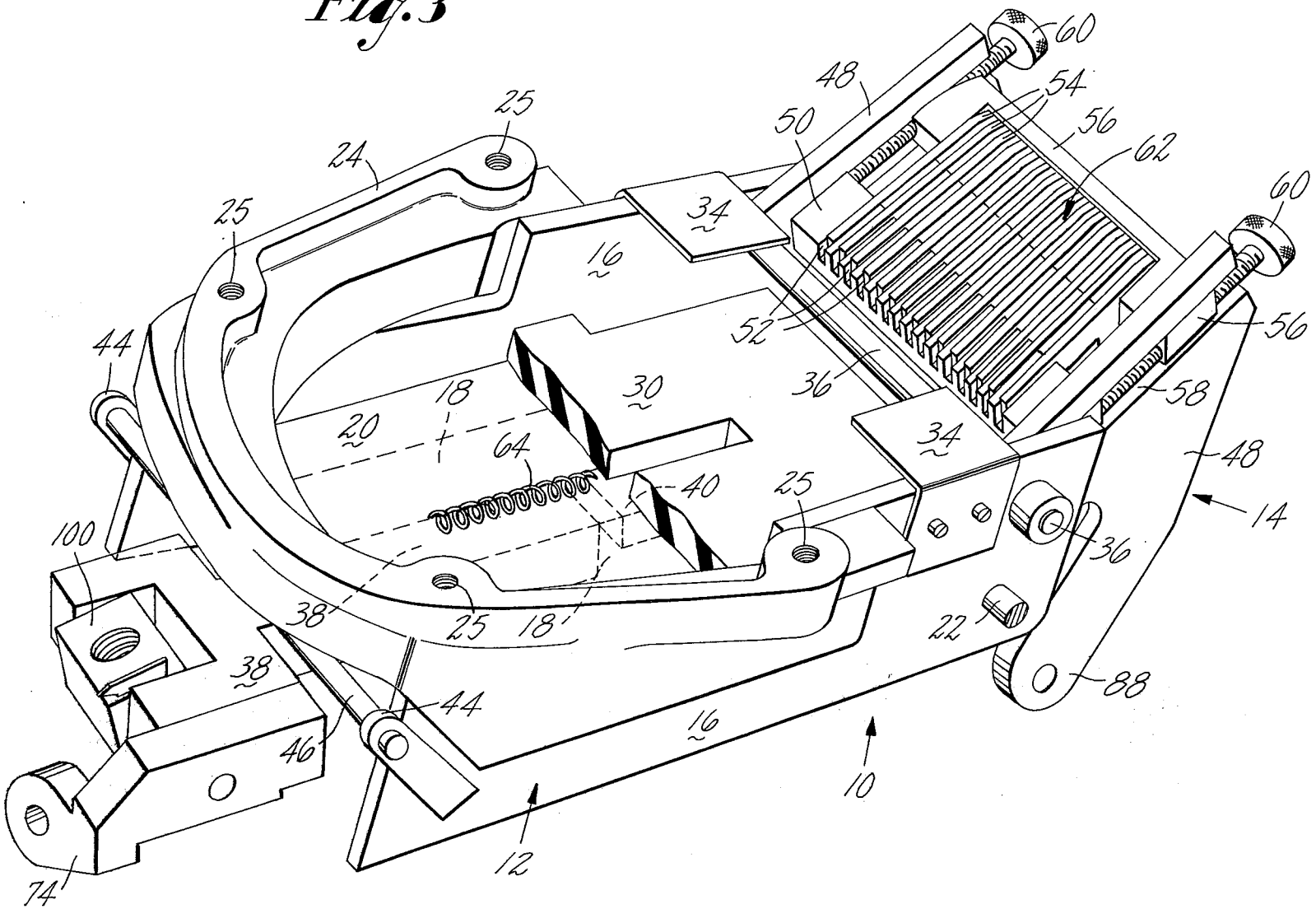
FIG. 3 is a perspective view of a support shown in FIG. 1 for shoe bottom engaging material of the illustrative pad box.

The pad box 3 also comprises a support generally designated 10 for shoe bottom engaging material which is mounted for pivoting movement on the framework 4 between the side plates 6 (see FIG. 1). The support 10 comprises a first supporting member 12 and a second supporting member 14. The first supporting member 12 comprises two side plates 16 (FIG. 3) and two support bars 18 disposed between the plates 16. Secured to the upper surfaces of the two support bars 18 is a plate 20 of the member 12 which extends between the two side plates 16. The support bars 18 and the side plates 16 have a cylindrical shaft 22 of the framework 14 passing therethrough so that they can pivot about the shaft 22. The shaft 22 extends transversely of the box 3 and is supported by the side plates 6. The shaft 22 also serves as the pivot about which the support 10 is mounted for pivoting movement. A forward end portion of the plate 20 is turned upwardly at 21 and is secured to a U-shaped block 24 of the member 12 (see FIG. 3) which passes over the two side plates 16 and is secured thereto. The block 24 is provided with holes 25 in an upper surface thereof and a clamping member 26 (FIG. 1 but omitted from FIG. 3) is secured to the block 24 by screws 27 which enter the holes 25. The clamping member 26 is also U-shaped and acts to clamp a peripheral edge of flexible material such as a leather sheet 28 to the block 24. The leather sheet 28 constitutes the shoe bottom engaging material supported by the support 10.

The first supporting member 12 also comprises a rubber pad 30 secured to an upper surface of the plate 20 within a recess defined by the U-shaped block 24. On top of the rubber pad 30 rests a rubber pad 32 which provides resilient backing for the leather sheet 28. The rubber pad 32 is held on the member 12 by being fitted under two clips 34 (FIG. 3) of the member 12 which are mounted on the side plates 16 at a rearward end portion of the member 12. The member 12 also comprises a shaft 36 which is supported by the side plates 16 and extends transversely of the box 3. The shaft 36 has the second supporting member 14 pivotally mounted thereon so that the first and the second supporting members 12 and 14 are pivotally interconnected. The first supporting member 12 also comprises a Y-shaped block 38 (FIGS. 1 and 3) screwed to the underside of the plate 20, a rearward bracket 40 also screwed to the underside of the plate 20, a forward bracket 42 depending from the block 38, two ears 44 which extend forwardly and upwardly one from each of the side plates 16, and a cylindrical shaft 46 supported between the ears 44. The purpose of the parts 38, 40, 42 and 46 will appear from the description below.

The second supporting member 14 comprises a pair of side plates 48 which are pivotally mounted on the shaft 36. Adjacent the shaft 36, a bar 50 (FIG. 3) of the member 14 interconnects the side plates 48. The bar 50 has a plurality of slots 52 in an upper surface thereof (see FIG. 3), into which slots 52 an equal number of projections 54 from a bar 56 of the member 14 are received, the projections 54 being slidable in the slots 52. Opposite end portions of the bar 56 are slidable in slots 58 in the side plates 48 and the bar 56 can be moved relative to the bar 50 by means of two adjustment screws 60. The screws 60 allow the length of a composite surface 62 provided by upper surfaces of the bars 50 and 56, including the projections 54, to be varied. Thus the effective length of the support provided by the bars 50 and 56 can be adjusted while still providing a substantially continuous supporting surface for the leather sheet 28. The rubber pad 32 extends from the member 12 across the surface 62 and passes around the bar 56. A rearward end of the rubber pad 32 is secured to a spring 64 by a strap 66 (FIG. 1) so that the pad 32 is held taut around the bar 56. The toeward end of the spring 64 passes through a slot in the upturned portion of the plate 20 and is secured to the aforementioned shaft 46. The spring 64 rests on the plate 20 in a recess provided therefor in the rubber pad 30. The leather sheet 28 also extends from the member 12 across the rubber pad 32, where the latter is supported by the surface 62, and passes around the bar 56. Thus the leather sheet 28, which as aforesaid forms shoe bottom engaging material of the pad box 3, has a portion thereof supported by the first supporting member 12 and a portion thereof supported by the second supporting member 14.

The pad box 3 also comprises first adjustment means by which the angle between the first and second supporting members 12 and 14 may be adjusted by pivoting the member 14 about the shaft 36. The first adjustment means comprises a screw 68 (FIG. 1) mounted for rotation between the aforementioned brackets 40 and 42. The first adjustment means also comprises a cog wheel 70 mounted on the screw 68 adjacent the bracket 42, a shaft 72 mounted for rotation between the bracket 42 and one of the forwardly extending arms 74 of the aforementioned Y-shaped block 38, and a cog wheel 76 mounted on the shaft 72 and meshed with the cog wheel 70. The shaft 72 is restrained against longitudinal movement thereof by a collar 78 thereon adjacent the bracket 42 and has a handle 80 thereon by which the shaft 72 can be turned. The first adjustment means also comprises a block 82 which has a threaded bore therein which is engaged by the screw 68. A pair of links 84 of the first adjustment means are pivotally connected to opposite sides of the block 82 and are pivoted on a shaft 86 supported between downwardly and forwardly extending portions 88 of the side plates 48. The arrangement is such that, because the block 82 is restrained against rotation by its connection with the links 84, turning of the screw 68 causes the block 82 to move longitudinally of the screw 68 thereby causing the links 84 to move the shaft 86 and thereby pivoting the member 14 about the shaft 36 thus selectively altering the angle between the members 12 and 14. The screw 68 can be turned by turning the handle 80 and therefore the shaft 72 and the cog wheel 76. Turning of the cog wheel 76 causes the cog wheel 70 and therefore the screw 68 to turn.

The pad box 3 also comprises second adjustment means by which the support 10 may be adjusted pivotally relative to the framework 4 without alteration of the angle between the two supporting members 12 and 14. The second adjustment means comprises an adjustment screw 90 (FIG. 1) extending generally upwardly and mounted for rotation between a lower block 92 pivotally mounted on a foward one of the connecting members 8 and an upper block 94 mounted on a bracket 96 supported by the block 92. The screw 90 has a handle 98 secured thereto by which it can be turned. The second adjustment means also comprises a block 100 which has a threaded bore therethrough in which the screw 90 is engaged. The block 100 is pivotally mounted between the arms 74 so that it is restrained against rotation and, when the screw 90 is turned, moves longitudinally of the screw 90. Longitudinal movement of the block 100 on the screw 90 causes the Y-shaped block 38 and therefore the entire member 12 and the member 14 to pivot about the shaft 22 without alteration of the selected angle between the members 12 and 14. A pointer 102 is mounted on top of the block 100 so that, by reference to the pointer 102, the tilt of the support 10 can be adjusted relative to a scale marked on the bracket 96.

At a rearward end portion of the pad box 3 (see FIG. 2), the side plates 6 support a shaft 104 which extends transversely of the pad box 3. Two supporting arms 106 (one visible in FIG. 2) are pivotally mounted on the shaft 104 and extend forwardly thereof. Each of the arms 106 has a support member 108 slidably mounted thereon. The members 108 each comprise a portion 110 which rests on top of its associated arm 106, a plate portion 112 which depends from the portion 110 and an arm portion 114 which extends generally forwardly from the plate portion 112. Each of the arm portions 114 carries a stud 116 which extends into a slot 118 in the associated arm 106 and each portion 110 has a slot 120 therein through which a locking screw 122 slidably extends. Each locking screw 122 is threadedly received in a bore in the associated arm 106 and the arrangement accordingly is such that the support members 108 can each slide relative to their associated arm 106 unless locked in position by means of the associated locking screw 122. Forward end portions of the arm portions 114 support between them a transverse shaft 124 on which an adjustable supporting member generally designated 126 for shoe bottom engaging material rests for pivoting movement about the shaft 124. The supporting member 126 is arranged to support shoe bottom engaging material in the form of a rubber pad 128 so that, when the pad box 3 is in use to apply pressure to the bottom of the shoe S, the pad 128 engages a heel portion of the bottom of the shoe S. The member 126 comprises a pair of parallel side plates 130 and a bridging plate 132. The plate 132 is supported by the plates 130 and also by a transverse shaft 134 supported between the plates 130. The rubber pad 128 is secured to an upper surface of the plate 132, and a lower surface of the plate 132 rests on the shaft 124. Angle pieces 136 may depend from the plate 132 and abut the shafts 124 and 134 so that the member 126 is longitudinally restrained and does not slip off the shaft 124.

Each of the side plates 130 has an arcuate rearward edge which is provided with a series of teeth 138 forming a ratchet. The member 126 is pevented from pivoting about the shaft 124 by a pair of pawls 140 which are fixedly mounted on a shaft 142 which is pivotally mounted in holes in the plate portions 112. The pawls 140 engage the teeth 138 thereby preventing the member 126 from pivoting and are urged against the side plates 130 by a spring 144 which acts between one of the pawls 140 and one of the plate portions 112. The arrangement is such that the position of the supporting member 126 can be adjusted longitudinally of the box 3 by loosening the locking screws 122, sliding the support members 108 relative to the arms 106 and then tightening the screws 122 again. Furthermore, the angle of the rubber pad 128 can be adjusted to conform to the inclination of the heel portion of the bottom of the shoe S, suppported by the box 3, when clamped in operating position in the press, by disengaging the pawls 140 from the teeth 138, pivoting the supporting member 126 about the shaft 124 and then reengaging the pawls 140 with the teeth 138.

Figure 2:
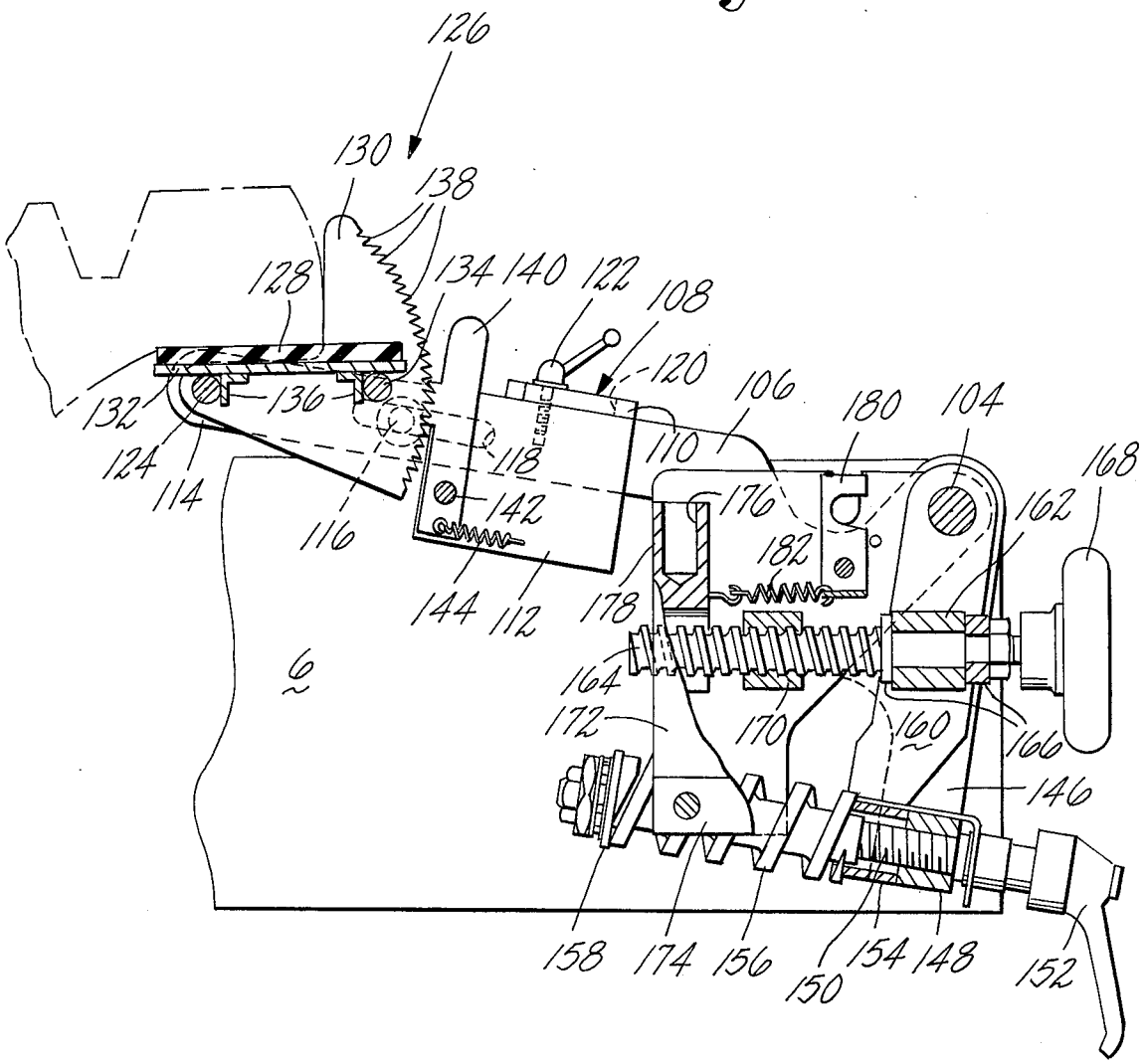
FIG. 2 is a view similar to FIG. 1 but of a rearward or heel end portion of the illustrative pad box.

The arms 106 each have a downwardly-extending portion 146 (FIG. 2). A block 148 is pivotally supported between the portions 146 and has a screw 150 threadedly received in a bore thereof. The screw 150 longitudinally of the pad box 3 and has a handle 152 secured thereto by which it can be turned. The screw 150 also passes through a smooth bore in a block 154 which is forward of the block 148 and abuts it. A spring 156 acts between the block 154 and a nut 158 threaded onto the screw 150, the screw 150 threading the spring 156, so that the spring 156 holds the block 154 against the block 148. The arrangement is such that turning the screw 150 reduces or increases the distance between the block 154 and the nut 158 thereby reducing or increasing the influence of the spring 156 and therefore, for a purpose to be explained, increasing or reducing the force with which the spring 156 urges the block 154 against the block 148.

The block 154 is pivotally mounted between two links 160 which are pivoted on the shaft 104 between the arms 106. Nearer the shaft 104 than the block 154, a further block 162 (FIG. 2) is pivotally mounted between the links 160, and passing through a smooth bore in the block 162 is an adjustment screw 164. The screw 164 is restrained against longitudinal movement relative to the block 162 by collars 166 on the screw 164. The screw 164 extends longitudinally of the box 3 and can be turned by means of a handle 168 secured to a rearward end portion thereof. The screw 164 is threadedly received in a bore which passes through a block 170 which is pivotally mounted between two fixed confronting members 172. The members 172 have transversely-extending portions 174 which are screwed to the side plates 6. The members 172 are thus fixedly mounted on the framework 4. The members 172 pass around the shaft 104, and the screws 164 and 150 extend between the members 172. The arrangement is thus such that, by turning the screw 164, the links 160 are pivoted with the block 154 about the shaft 104. As the links 160 pivot about the shaft 104, the block 154 is pressed against the block 148 by the spring 156 thereby causing the arms 146 and 106 to pivot about the shaft 104 and the height of the shoe supporting member 126 to be altered.

To use the pad box 3 to apply pressure to the bottom of the shoe S, the box 3 is mounted in a press having means for moving the box 3 heightwise relative to a toe post T (FIG. 1) and a heel post H of the press. An operator adjusts the pad box 3 so that its sheet 28 conforms to the shape of the bottom of the shoe S thereby enabling the press to apply a uniform pressure. The operator first positions the shoe S on the leather sheet 28 with its toe end pointing forwardly of the box 3, the forepart portion of the bottom of the shoe S resting over the member 12, and the waist portion of the bottom of the shoe S resting over the member 14. The operator turns the handle 80, thereby pivoting the member 14 about the shaft 36, until the angle between the members 12 and 14 conforms to the angle between the forepart portion and the waist portion of the bottom of the shoe S so that the leather sheet 28 fits snugly against the bottom of the shoe S. A portion of the leather sheet 28 supported by the member 12 engages the forepart portion of the bottom of the shoe S and a portion of the sheet 28 supported by the member 14 engages the waist portion of the bottom of the shoe S. If necessary, the operator turns the adjustment screws 60 (FIGS. 1, 3) to bring the effective length of the member 14 into conformity with the length of the waist portion of the bottom of the shoe S. After adjusting the angle between the members 12 and 14, the operator turns the handle 98 thereby pivoting the support 10 bodily about the shaft 22; this is done to bring an upper surface A (FIG. 1) of the last L parallel or substantially parallel to a pressing pad on the heel post H so that pressure can be transmitted from the post H to the last L and thereby to the shoe S.

After adjusting the support 10 as aforesaid, the operator adjusts the supporting member 126 so that the rubber pad 128 rests against the heel portion of the bottom of the shoe S immediately rearwardly of the member 14. The height of the member 126 is adjusted by means of the handle 168, the longitudinal position of the member 126 is adjusted by sliding and clamping the support members 108 relative to the arms 106, and the inclination of the rubber pad 128 is adjusted by means of the ratchets on the side plates 130 and the pawls 140. If necessary, the operator also turns the handle 152 to adjust the force with which the spring 156 urges the block 154 against the block 148; this force is directly porportional to the force required to be exerted on the supporting member 126 to cause the arms 106 to pivot counterclockwise (as seen in FIG. 2) about the shaft 104 since the spring 156 opposes this movement.

After the various adjustments have been made, the press can be operated raising the box 3 so that the shoe S is clamped between the box 3 and the posts H and T, and well distributed pressure is applied to the bottom of the shoe S. The pad box 3 can be used for applying pressure to further shoes of the same shape and size as the shoe S without further adjustment, and by using the mechanisms described can be easily and rapidly adjusted to conform to many different shapes or sizes of shoe. Furthermore, if a shoe to have pressure applied thereto has a heel attached thereto, the supporting member 126 can be moved to an out-of-the-way position by turning the handle 168. A detachable heel pad support (not shown) may then be mounted on the pad box 3. The heel pad support can be mounted on the members 172 by having a portion located in a mating hole 176 in a block rigidly secured between the members 172 and held in place by a catch member 180 pivotally mounted between the members 172 and operated by a spring 182 attached to one of the members 172. Such a heel pad support may comprise a support portion, arranged to be mounted by means of the hole 176 and the catch member 180, and an arm portion slidable relative to the support portion and carrying a heel pad arranged to support a heel during a pressing operation.

Having thus described my invention and what I claim and as new and desire to secure by Letters Patent of the United States is:

1. A pad box for applying pressure to the bottom of a shoe comprising a frame, conformable material engageable with the shoe bottom, means mounted on the frame for supporting said material and including in pivotal relation a forepart supporting member and a waist supporting member, a heel supporting member movably mounted on the frame adjacent to a rearward end portion of the waist supporting member for adjustment lengthwise and heightwise of the shoe, mechanism for adjusting the angle between the forepart and waist supporting members, and further adjustment mechanism for jointly tilting the forepart and waist supporting members relative to the frame without altering a selected angle of adjustment between them.

2. A pad box for applying pressure to the bottom of a shoe comprising a frame, a conformable leather sheet clamped at one end of a toe end portion of the frame and engageable with the shoe bottom, means mounted on the frame for supporting said sheet and including in pivotal relation a forepart supporting member and a waist supporting member, a resilient pad extending between said members and the leather sheet, yieldable means interconnecting the frame and the pad to maintain the latter taut while overlying the members, mechanism for adjusting the angle between said supporting members, and further adjustment mechanism for jointly tilting said members relative to the frame without altering a selected angle of adjustment between them.

3. A pad box as in claim 1 further characterized in that means is provided for adjusting the heel supporting member angularly about an axis extending transversely of the frame.

* * * * *